US007417608B2

(12) United States Patent
Kaneko et al.

(10) Patent No.: US 7,417,608 B2
(45) **Date of Patent: *Aug. 26, 2008**

(54) ORGANIC LIGHT EMITTING DIODE DISPLAY AND OPERATING METHOD OF DRIVING THE SAME

(75) Inventors: Yoshiyuki Kaneko, Hachioji (JP); Takayuki Ouchi, Hitachi (JP); Nobuaki Kabuto, Kunitachi (JP); Toshihiro Sato, Mobara (JP)

(73) Assignee: Hitachi, Ltd., Tokyo (JP)

( * ) Notice: Subject to any disclaimer, the term of this patent is extended or adjusted under 35 U.S.C. 154(b) by 503 days.

This patent is subject to a terminal disclaimer.

(21) Appl. No.: 11/077,032

(22) Filed: Mar. 11, 2005

(65) Prior Publication Data

US 2005/0167691 A1 Aug. 4, 2005

Related U.S. Application Data

(63) Continuation of application No. 10/437,194, filed on May 14, 2003, now Pat. No. 6,882,113, which is a continuation of application No. 09/934,567, filed on Aug. 23, 2001, now Pat. No. 6,583,581.

(30) Foreign Application Priority Data

Jan. 9, 2001 (JP) ..... 2001-000956

(51) Int. Cl.
*G09G 3/30* (2006.01)

(52) U.S. Cl. ..... 345/76; 345/46; 345/79; 345/83; 345/92; 345/94; 315/169.1; 315/169.3; 313/498

(58) Field of Classification Search ..... 345/74–79, 345/81, 82, 211, 204, 690
See application file for complete search history.

(56) References Cited

U.S. PATENT DOCUMENTS

| | | | | |
|---|---|---|---|---|
| 5,550,066 | A | 8/1996 | Tang et al. | |
| 6,072,517 | A | 6/2000 | Fork et al. | |
| 6,084,579 | A * | 7/2000 | Hirano | 345/205 |
| 6,229,508 | B1 | 5/2001 | Kane | |
| 6,580,657 | B2 | 6/2003 | Sanford et al. | |
| 6,583,581 | B2 * | 6/2003 | Kaneko et al. | 315/169.3 |

(Continued)

FOREIGN PATENT DOCUMENTS

EP 2000268957 * 9/2000

(Continued)

OTHER PUBLICATIONS

"Development for Drive Circuitry for an Organic EL Dot-Matrix Display," Pioneer R&D, vol. 8, No. 3, pp. 41-49.

*Primary Examiner*—Richard Hjerpe
*Assistant Examiner*—Jennifer T Nguyen
(74) *Attorney, Agent, or Firm*—Dickstein Shapiro LLP

(57) ABSTRACT

An organic LED (OLED) display device and an operating method of driving the same. In an OLED image display device, one switch transistor is provided in one pixel. For at least a part of an OFF period of time of the switch transistor, the OLED is in the non-light emission state, and also the bias of the polarity reverse to that in the light emission is applied to the OLED.

6 Claims, 5 Drawing Sheets

U.S. PATENT DOCUMENTS

| | | | | |
|---|---|---|---|---|
| 6,611,245 | B1 * | 8/2003 | Edwards | 345/76 |
| 6,882,113 | B2 * | 4/2005 | Kaneko et al. | 315/169.3 |

FOREIGN PATENT DOCUMENTS

| | | | |
|---|---|---|---|
| JP | 04-125683 | | 4/1992 |
| JP | 08-241048 | | 9/1996 |
| JP | 11-008064 | * | 1/1999 |
| WO | WO 98-36407 | | 6/1998 |

* cited by examiner

ORGANIC LIGHT EMITTING DIODE DISPLAY AND OPERATING METHOD OF DRIVING THE SAME

This application is a continuation of application Ser. No. 10/437,194, filed May 14, 2003 now U.S. Pat. No. 6,882,113, which is a continuation of application Ser. No. 09/934,567, filed Aug. 23, 2001, now U.S. Pat. No. 6,583,581.

BACKGROUND OF THE INVENTION

The present invention relates to an active matrix type display device employing light emitting devices such as EL (electro-luminescence) devices or LEDs (light emitting diodes) each of which emits light by causing a driving current to flow through a light emitting thin film such as an organic semiconductor thin film, and thin film transistors for controlling the light emitting operation of the respective light emitting devices.

In recent years, as the advanced information society has come, there has been increasing demands for personal computers, portable information terminals, information communication apparatuses or complex products thereof. A thin and light-weight display device is suitable for these products, and hence the liquid crystal display device or the display device constituted by the self-light emitting type EL devices or the LED devices. The self-light emitting type display device of the latter has the features that the visibility is excellent, the visible angle characteristics are wide, it is suitable for the moving pictures since it is excellent in the high speed response, and so forth, and hence it is expected that the self-light emitting type display device will be important more and more in the information communication field in the future. In actual, recently, the rapid enhancement of the light emitting efficiency of the organic EL device or the organic LED device (hereinafter, the OLED is the general form for these devices) in which the organic material is used as the light emitting layer, and the advance of the network technology for making the image communication possible are combined to make the expectation to the OLED display device go on rising.

An example of the OLED display device according to the prior art is described in Pioneer R&D Vol. 8, No. 3, pp. 41 to 49. In accordance with this example, as shown in FIG. 6A, OLEDs are respectively arranged in the intersections of n anodes 61 which extend longitudinally and m cathodes 62 which extend transversely to form a simple matrix in which pixels P11, . . . , Pmn are provided. Then, each of the anode lines is driven by a constant current voltage-source 63 every cathode line to scan the cathode lines in the line-at-a-time manner. In such a way, the time division driving is carried out. Each of the pixels can be expressed in the form of an equivalent circuit shown in FIG. 6B, in which a parasitic capacity 65 is parasitically connected in parallel with an OLED 64. The value of this parasitic capacity 65 is so large as to be about 20 pF in the square of 0.3 mm×0.3 mm, and hence in order to obtain the desired picture quality by the time division driving requiring the high speed as described above, it is necessary to devise the driving waveform for which the charge and discharge of the electric charges to and from the parasitic capacity are taken into consideration. In actual, in the above-mentioned prior art, there is adopted the complicated driving method wherein the timing in which all of the electrodes are grounded once is provided.

Instead of the above-mentioned simple matrix, the active matrix driving in which TFTs are provided in the pixels, respectively, has also been studied. The technology for manufacturing the OLED display device in the form of the active matrix structure to drive the same, for example, is disclosed in JP-A-8-241048 and U.S. Pat. No. 5,550,066, and also in WO98/36407 in which the contents of the driving voltage are described in more detail. For the typical pixels of the OLED display device of the active matrix system thus disclosed, as shown in FIG. 7, the light emission luminance of the OLED 76 is controlled by the active device driving circuit constituted by at least two TFT switch transistor Tsw73 and driver transistor Tdr74, and one accumulation capacitor 75. More specifically, the voltage corresponding to the electric charges which are accumulated in the accumulation capacitor 75 through the switching transistor 73 provides the gate voltage of the driver transistor 74, and the OLED 76 is driven by the current which is determined on the basis of the gate voltage. However, in actual, there arises the problem that the ununiformity of the display picture quality is generated due to the ununiformity of the threshold voltage and the charge drift mobility of the driver transistor.

As for the system having the possibility of clearing the above-mentioned two problems, as shown in FIG. 8, the active matrix system of providing one transistor in one pixel to carry out the driving is disclosed in JP-A-4-125683.

SUMMARY OF THE INVENTION

In the one pixel-one transistor system disclosed in the above-mentioned prior art, it is possible to realize the uniform display characteristics on the basis of the simple pixel structure and driving method. However, since the light emission time of the pixels of this system is equal to that of the simple matrix system, the current value must be increased. While under such a situation, the means for ensuring the reliability of the device is required, any of the effective techniques therefor has not yet been disclosed.

According to the present invention, there is provided an OLED display device in which a single switch transistor is provided in each of pixels, and a constant current-voltage source is connected to the outside of a panel in order to carry out the driving, wherein in order to reduce the degradation of the luminance characteristics due to the flowing of a large current through the OLED, the voltage scheme is adopted in which in the conduction of the switch transistor, a reverse bias is applied to the OLED, and a driving waveform is provided in which the reverse bias is held in the non-conduction of the switching transistor. In addition, in order to reduce the level of a momentary current which is caused to flow through the OLED, a ramp wave or a square wave is applied to one side electrode of an accumulation capacitor to provide a driving waveform in which a current contributing to the light emission is caused to flow even in the non-conduction of the switching transistor.

According to one aspect of the present invention, there is provided an organic LED display device including: thin film transistors in which a plurality of gate lines and a plurality of data lines intersecting the plurality of gate lines are provided on a substrate, pixels are defined by the plurality of gate lines and the plurality of data lines, and a gate scanning signal is applied to the pixels through the gate lines, respectively; and light emitting devices each of which emits light by a driving current, which is caused to flow between an associated one of pixel electrodes formed in correspondence to the pixels and an associated one of counter electrodes opposite to the respective pixel electrodes, in accordance with a data signal which is supplied from the associated one of the data lines synchronously with a timing when the associated one of the thin film transistors becomes the conduction state, wherein each of the light emitting devices is an organic LED device, and for a part of a period of time when the associated one of the thin film transistors is in the non-conduction state, the associated one of the organic LED devices is in the non-light emission state, and also a bias having the polarity reverse to that in the light emission is applied thereto.

According to another aspect of the present invention, there is provided an organic LED display device including: thin film transistors in which a plurality of gate lines and a plurality of data lines intersecting the plurality of gate lines are provided on a substrate, pixels are defined by the plurality of gate lines and the plurality of data lines, and a gate scanning signal is applied to the pixels through the gate lines, respectively; and light emitting devices each of which emits light by a driving current, which is caused to flow between an associated one of pixel electrodes formed in correspondence to the pixels and an associated one of counter electrodes opposite to the respective pixel electrodes, in accordance with a data signal which is supplied from the associated one of the data lines synchronously with a timing when the associated one of the thin film transistors becomes the conduction state, wherein each of the light emitting devices is an organic LED device, each of accumulation capacitors is connected in parallel with the associated one of the organic LED devices, electrodes of the associated ones of the accumulation capacitors are connected to a common electrode every row, the common electrode is connected to a power source different from that of common electrode of the organic LED devices, and for a part of a period of time when the associated one of the thin film transistors is in the non-conduction state, the associated one of the organic LED devices is in the non-light emission state, and also a bias having the polarity reverse to that in the light emission is applied thereto.

BRIEF DESCRIPTION OF THE DRAWINGS

The above and other objects as well as advantages of the present invention will become clear by the following description of the preferred embodiments of the present invention with reference to the accompanying drawings, wherein.

DESCRIPTION OF THE EMBODIMENTS

The embodiments of the present invention will hereinafter be described in detail with reference to the accompanying drawings. First, hereinbelow, the overall configuration of an image display device will be described, and next the operating method of driving the same according to the present invention will be described.

First Embodiment

Figure 1:
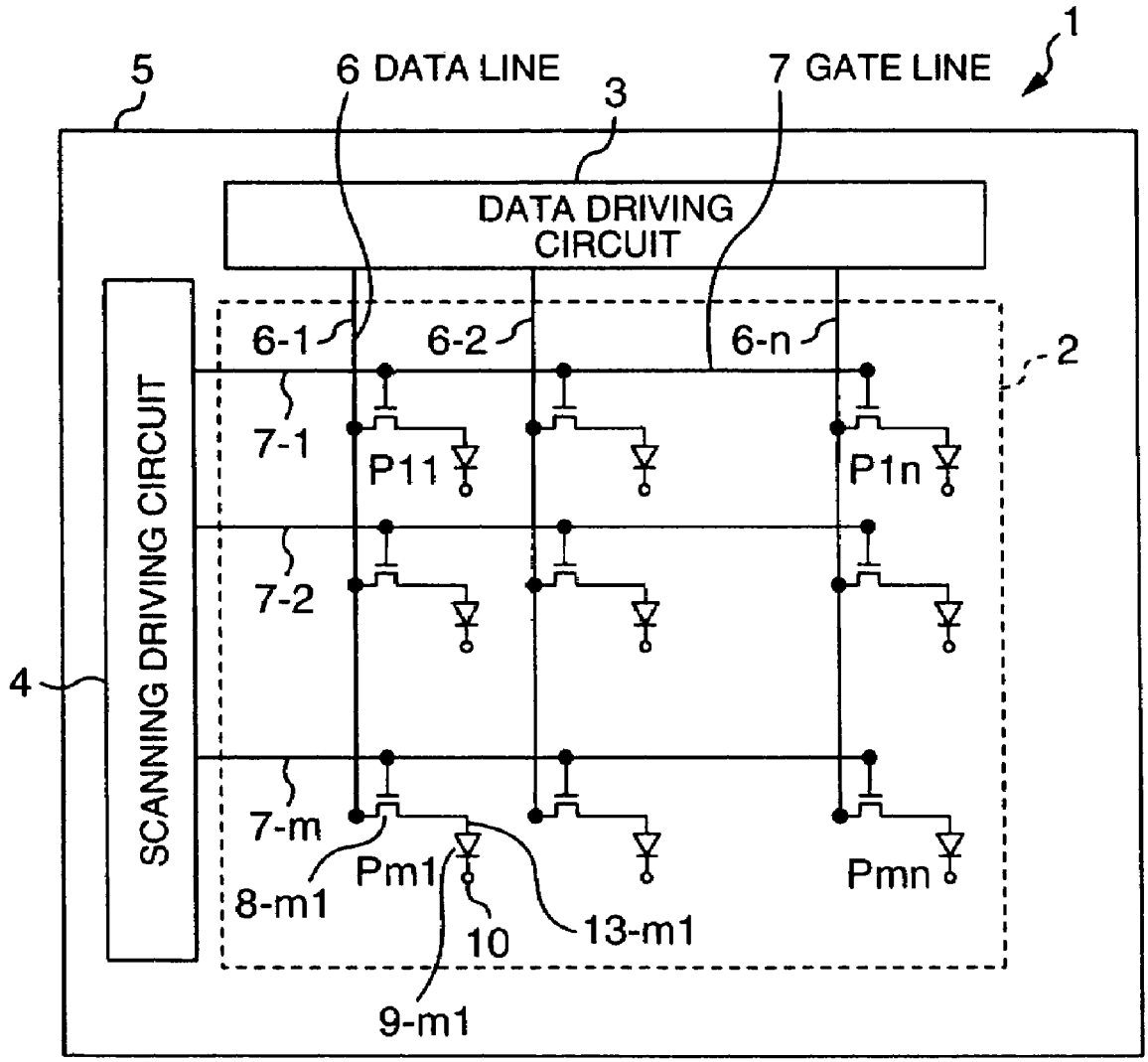
FIG. 1 is a circuit diagram, partly in block diagram, showing schematically a configuration of an OLED image display device according to one embodiment of the present invention.
Figure 2:
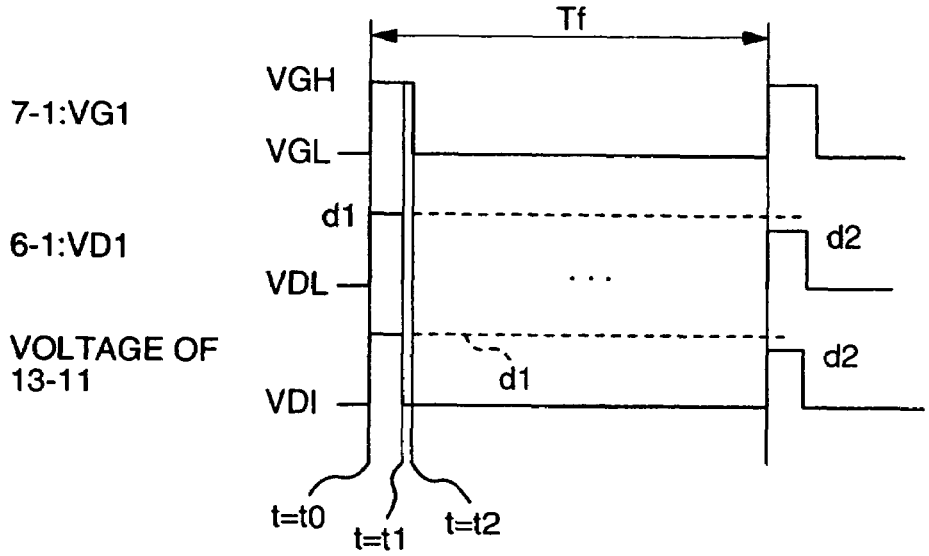
FIG. 2 is a time chart useful in explaining the driving of the OLED image display device shown in FIG. 1.

FIG. 1 is a circuit diagram, partly in block diagram, showing schematically the overall layout of an image display device 1. In the image display device 1, a display portion 1 is arranged roughly in the center portion of a substrate 5. A data driving circuit 3 for outputting image signals to data lines 6 is provided on the upper side of the display portion 2, while a scanning driving circuit 4 for outputting a scanning signal to gate lines 7 is provided on the left side of the display portion 2. The matrix having m rows and n columns is defined by the m gate lines 7 and the n data lines 6. An n-channel switching transistor 8 and an OLED 9 are formed in each of the pixels of the display portion 2. As for the transistors, poly-silicon thin film transistors which are formed by the thin film process are employed. Drains of the switch transistors in each of the columns are connected to the associated one of the data lines 6, and sources thereof are respectively connected to the associated ones of anodes 13 of the OLEDs 9. Cathodes of the OLEDs 9 are an electrode 10 which is common to the pixels. FIG. 2 is a time chart showing the relationship of a pulse waveform VG1 applied to the gate line 7-1, a pulse waveform VD1 applied to the data line 6-1, and the change of the voltage at the anode 13-11 of the OLED in the pixel of one row and one column against the common electrode 10 of the OLEDs.

When at a time t=t0, the switch transistor 8-11 is turned ON by the gate scanning signal, the data signal which is applied to the associated data line synchronously therewith flows into the OLED 9-11 through the switch transistor 8-11. As long as for the value of the general data signal d1, the value of the gate scanning signal fulfills at least the relationship of VGH−Vth>d1, the injection of the current into the OLED is smoothly carried out. By the way, Vth in that relationship represents the threshold voltage of the switch transistor 8-11. Next, when at a time t=t1, the switch transistor is in the ON state, the electric potential of the signal on the data line 6-11 is reduced down to VDL. Thereafter, at a time t=t2, the switch transistor is turned OFF. While in this case, only the data line 6-1 is shown, the driving is obedient to the so-called line-at-a-time system, and hence the data signals corresponding to the image are respectively applied to the data lines 6-2, . . . , 6-n as well at the above-mentioned timing so that the data signals for one row are written thereto. The electric potential at the anode 13-11 follows roughly the data signal waveform to be changed, and the diode forward current is caused to flow through the OLED due to the electric power difference between the electric potential at the anode 13-11 and the electric potential VOL at the common electrode 10 so that the OLED emits light.

The feature of the present invention is such that in the above-mentioned driving waveform, the relationship of VDL<VOL is set. As a result, during a period of time of the non-light emission, the reverse bias is applied to the OLED. This state of applying the reverse bias to the OLED is kept excellent as long as the switch transistor is in the OFF state. In the case of the n-channel switch transistor, preferably, the relationship of VDL>VGL has only to be fulfilled.

Since the number of gate scanning lines is m, if the frame period of time is Tf, then a time (t2−t0) for which the scanning signal is applied to one gate line becomes Tf/m at a maximum. As for a time (t2−t1) required to apply the reverse voltage, about 1 μsec. is sufficient since the switch transistor is kept in the state of the low impedance equal to or lower than about 10 kΩ. As a result, even if m is set to 1,000 and Tf is set to 16 msec., since t2−t0=16 μsec. is obtained, the influence exerted on the reduction of a period of time of the light emission can be reduced as much as possible.

As described above, according to the first embodiment of the present invention, there is offered the effect that in a simple OLED display device of one pixel-one transistor type, it is possible to realize a highly reliable OLED display device in which the image degradation is suppressed.

Second Embodiment

Figure 3:
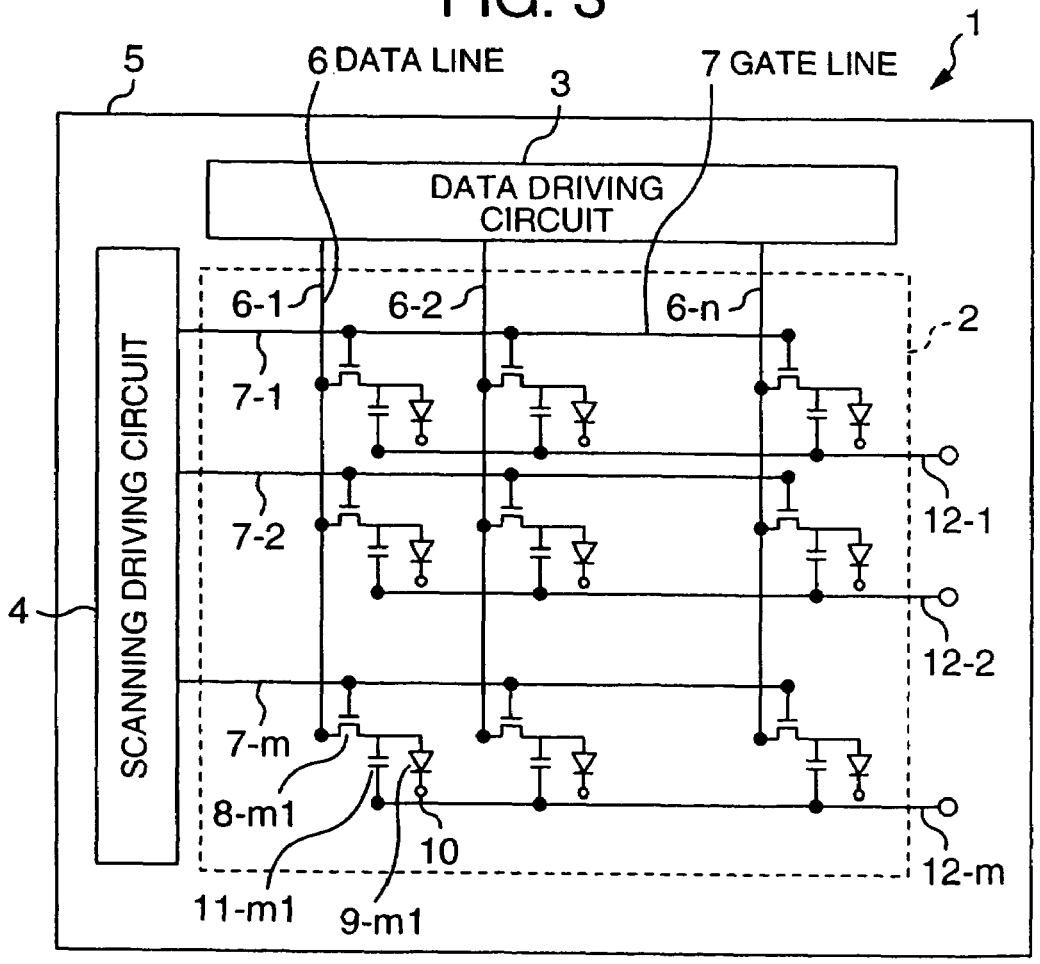
FIG. 3 is a circuit diagram, partly in block diagram, showing schematically a configuration of an OLED image display device according to another embodiment of the present invention.
Figure 4:
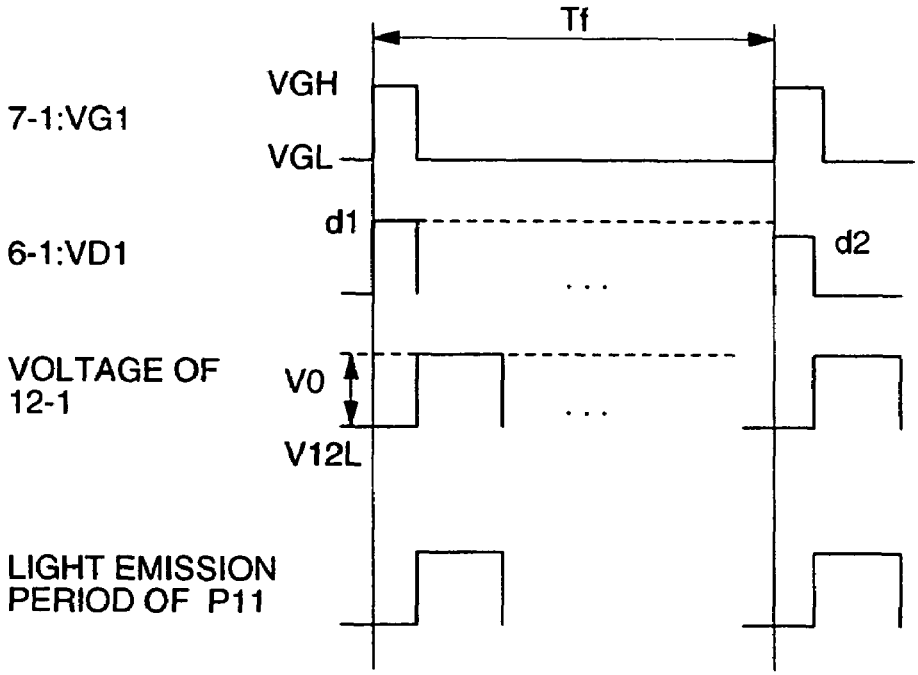
FIG. 4 is a time chart useful in explaining the driving of the OLED image display device shown in FIG. 3.

A second embodiment of the present invention will hereinbelow be described. FIG. 3, similarly to FIG. 1, is a circuit diagram, partly in block diagram, showing schematically the overall layout of an image display device 1. A point of difference of FIG. 3 from FIG. 1 is that an electric charge accumulation capacitor 11 is provided in each of the pixels. One side electrodes of the electric charge accumulation capacitors 11 in each of the rows are bundled into a wiring 12 which is made different from the common electrode 10 of the OLEDs. FIG. 4 is a time chart useful in explaining the timing of the driving voltage of this image display device. For the voltage VG1 applied to the gate line 7-1 and the voltage VD1 applied to the data line 6-1, in the present embodiment, the timing of applying the reverse bias is unnecessary. For this selection period of time, the electric potential on the side opposite to an electrode 12-1 of the accumulation capacitor 11-11 is increased up to d1. The electric potential VOL of the common electrode 10 of the OLEDs is set in such a way that (d1−VOL) becomes smaller than the threshold voltage VthOL of the OLEDs. Next, after the associated one(s) of the switch transistor is(are) turned OFF, the square wave is applied to the electric potential of the wiring 12-1. Its amplitude, i.e., V0=(V12H−V12L) may be the value of about VthOL. As a result, the electric charges accumulated in the accumulation capacitor 11 flow through the OLED 9-11, and then the OLED 9-11 emits light. The value of the accumulation capacitor Cs11 is about 8 to about 20 times as large as that of the diode parasitic capacity of the OLED, and as a result, the picture luminance equal to or higher than 10 cd/m$^2$ is obtained. As for the dielectric material, $Al_2O_3$, $Ta_2O_5$ or the like may be employed. Since the pulse width of the square wave in this case, i.e., the period of time of the light emission can be made much larger than Tf/m shown in the first embodiment, the momentary current can be reduced. For example, the period of time of the light emission can also be made about Tf/4.

For the electric potential of the associated one of the wirings 12 after completion of the light emission, the relationship of V12L>VOL is fulfilled, whereby the reverse voltage is applied to the associated one of the PLEDs. It is to be understood that in this case as well, in order to hold the OFF state of the switch transistor, the relationship of V12L>VGL may be fulfilled.

Third Embodiment

Figure 5:
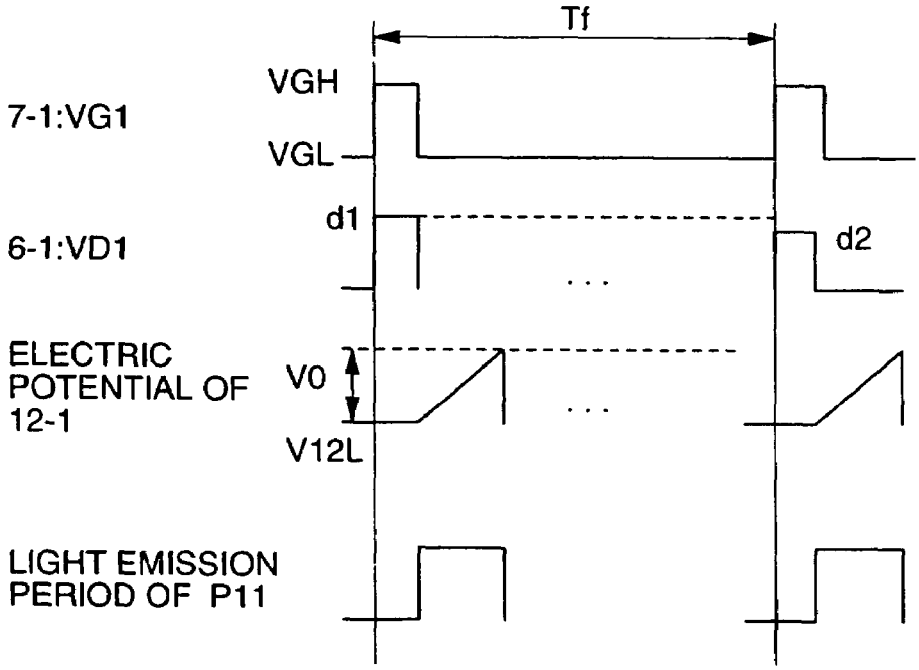
FIG. 5 is another time chart useful in explaining the driving of the OLED image display device shown in FIG. 3.
Figure 6A:
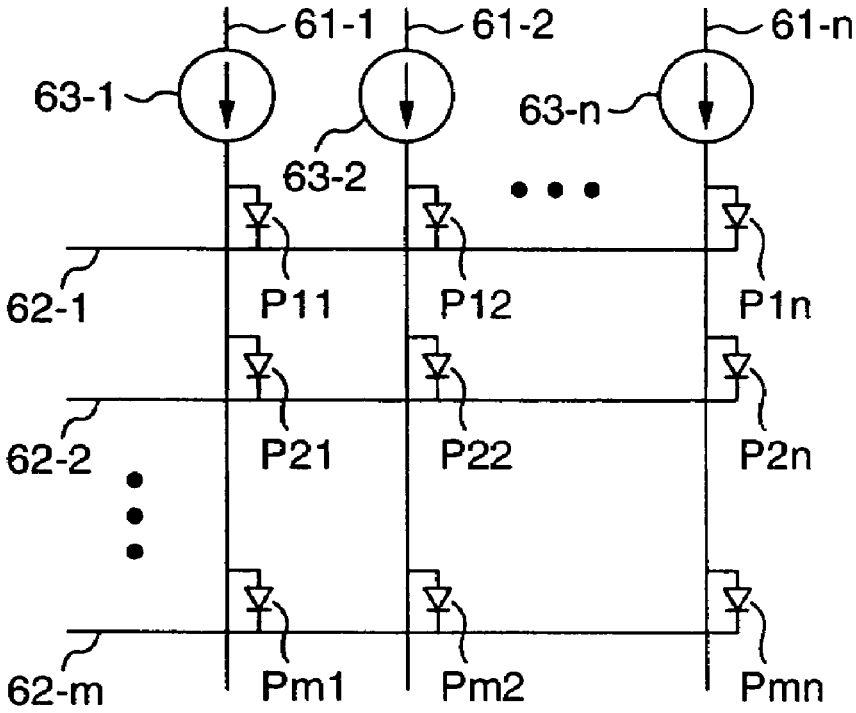
FIG. 6A and FIG. 6B are respectively a circuit diagram showing a configuration of a conventional OLED display device and a circuit diagram showing an equivalent circuit of each of pixels in the conventional OLED display device.
Figure 6B:
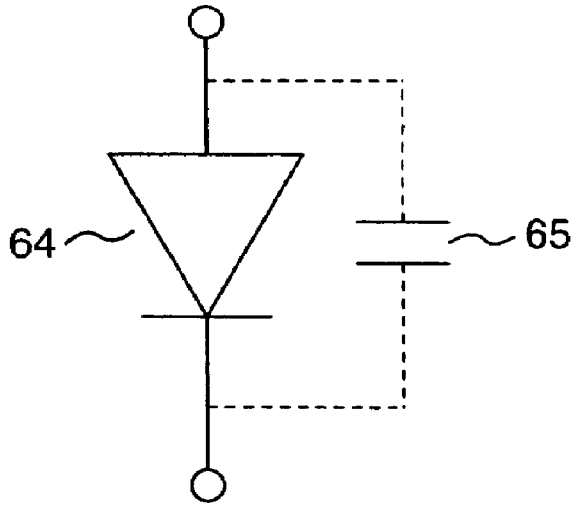
Figure 7:
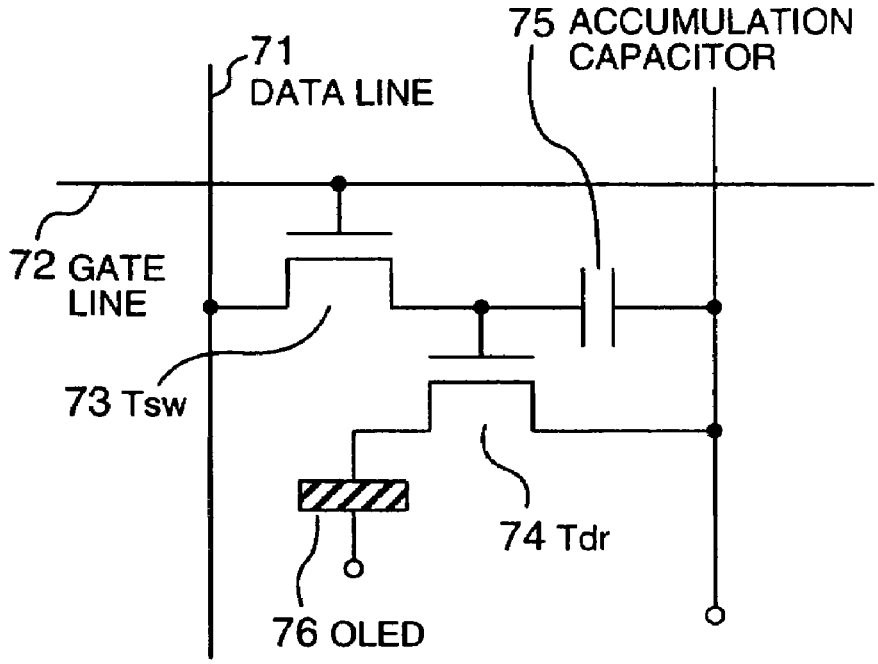
FIG. 7 is a circuit diagram showing a configuration of another conventional OLED display device.
Figure 8:
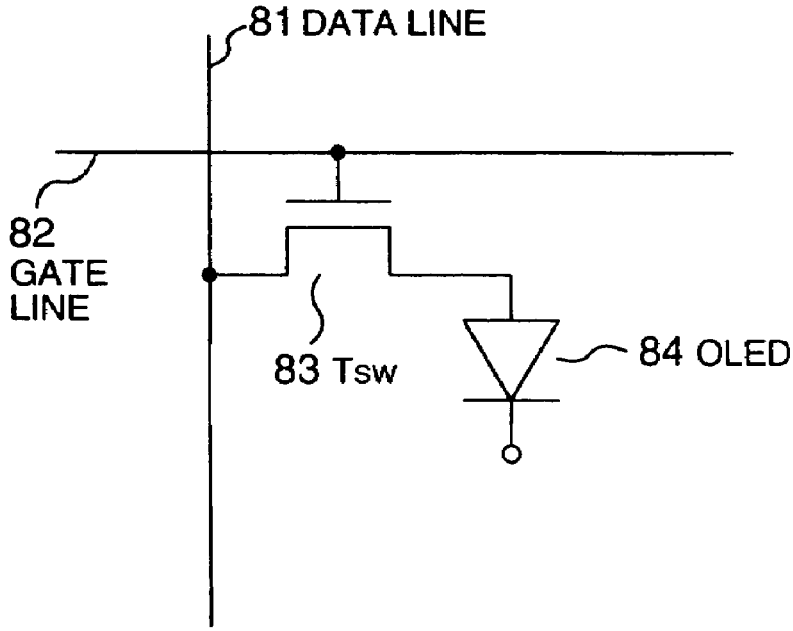
FIG. 8 is a circuit diagram showing a configuration of still another conventional OLED display device.

A third embodiment of the present invention will hereinbelow be described. The basic structure of the pixels is the same as that of the second embodiment shown in FIG. 3. The feature of the present embodiment is such that the voltage applied to the wirings 12 is not the square wave, but is the ramp wave as shown in FIG. 5. In this case as well, the relationships of V12L>VOL and V12L>VGL are fulfilled, whereby the excellent driving condition is kept.

Now, the effect inherent in the present embodiment is such that the change in the period of time of the light emission can be reduced. While if the square wave as in the second embodiment is employed, then the current which is caused to flow through the OLED is gradually reduced along with the lapse of time, since the fixed displacement current can be caused to flow through the OLED capacitor by applying the ramp wave to the wiring 12, the difference of the electric potential developed across the OLED can be kept fixed.

While above, the embodiments of the present invention have been described, the present invention is not intended to be limited to the above-mentioned embodiments. For example, while in the above-mentioned embodiments, there has been shown the example in which the anode of the OLED is connected to the switch transistor, even in the case as well where the cathode of the OLED is connected to the switch transistor, the driving method according to the present invention is also effective. In addition, it is to be understood that even when the channel conduction type of the switch transistor is the p-channel, the driving method according to the present invention is also effective.

As set forth hereinabove, according to an OLED display device of the present invention, in an operating method of driving a pixel display device wherein at least one TFT and one OLED are included in each of pixels which are arranged in a matrix in correspondence to a plurality of gate lines, a plurality of data lines and intersections therebetween, a reverse bias is applied for a period of time of the non-light emission, whereby a highly reliable display device can be realized.

In addition, according to the present invention, it is possible to provide an organic LED display device which is excellent in the reliability.

While the present invention has been particularly shown and described with reference to the embodiments and the specified modifications thereof, it will be understood that the various changes and other modifications will occur to these skilled in the art without departing from the scope and true spirit of the invention. The scope of the invention is therefore to be determined solely by the appended claims.

What is claimed is:

1. An organic LED display device comprising:

thin film transistors in which a plurality of gate lines and a plurality of data lines intersecting said plurality of gate lines are provided on a substrate, pixels are defined by said plurality of gate lines and said plurality of data lines, and a gate scanning signal is applied to said pixels through said gate lines, respectively; and light emitting devices each of which emits light by a driving current, which is caused to flow between an associated one of pixel electrodes formed in correspondence to said pixels and an associated one of counter electrodes opposite to the respective pixel electrodes, wherein each of said light emitting devices is an organic LED device, and for a part of a period of time when the associated one of said thin film transistors is in the non-conducting state, the associated one of said organic LED devices is in the non-light emission state, and is applied with a bias voltage having a polarity reverse to the polarity of said bias voltage applied to said associated organic LED device in the light emission state; and a reverse bias is applied to the organic LED by turning on an associated thin film transistor, such that the thin film transistor is in the conducting state, and, after an electric potential is established, the thin film transistor is changed to be in a nonconducting state such that the reverse bias is maintained.

2. An organic LED display device according to claim 1, wherein for a period of time when the associated one of said thin film transistors is in the conducting state, a voltage of the data signal is changed in such an order that, first a forward bias is applied to the associated one of said organic LED devices and then a reverse bias voltage is applied to said one organic LED device, said terms "forward" and "reverse" conform to those used in a voltage-current characteristic of organic LED devices.

3. An organic LED display device comprising:

thin film transistors in which a plurality of gate lines and a plurality of data lines intersecting said plurality of gate lines are provided on a substrate, pixels are defined by said plurality of gate lines and said plurality of data lines, and a gate scanning signal is applied to said pixels through said gate lines, respectively; and light emitting devices each of which emits light by a driving current, which is caused to flow between an associated one of pixel electrodes formed in correspondence to said pixels and an associated one of counter electrodes opposite to the respective pixel electrodes, the counter electrodes being first common electrodes, wherein each of said light emitting devices is an organic LED device, storage capacitors are formed, one for each pixel, one electrode of each storage capacitor is connected to a pixel electrode of an associated organic LED device and the other electrodes of the storage capacitors are connected to a second power supply via associated second common electrodes on a row by row basis and, for at least a part of a period of time when an associated thin film transistor is in the non-conduction state, the associated organic LED device is in the non-light emission state and is applied with a bias voltage having the polarity reverse to the polarity of said bias voltage applied to said associated organic LED device in the light emission state by changing a voltage of said second power supply; and a reverse bias is applied to the organic LED by turning on the associated thin film transistor, such that the thin film transistor is in the conducting state, and, after an electric potential is established, the thin film transistor is changed to be in a nonconducting state such that the reverse bias is maintained.

4. An organic LED display device according to claim 3, wherein after the associated one of said thin film transistors has become the non-conducting state, a voltage of the associated second common electrode is changed so that said associated one of the organic LED devices emits light.

5. An organic LED display device according to claim 4, wherein the voltage fluctuation given to said common electrode of said storage capacitors in each of the rows is a square wave.

6. An organic LED display device according to claim 4, wherein the voltage fluctuation given to said common electrode of said storage capacitors in each of the rows is a ramp wave.

* * * * *